US007186098B2

(12) United States Patent
Dreifert

(10) Patent No.: US 7,186,098 B2
(45) Date of Patent: Mar. 6, 2007

(54) ECCENTRIC PUMP AND METHOD FOR OPERATION OF SAID PUMP

(75) Inventor: Thomas Dreifert, Kerpen (DE)

(73) Assignee: Oerlikon Leybold Vacuum GmbH, Cologne (DE)

( * ) Notice: Subject to any disclaimer, the term of this patent is extended or adjusted under 35 U.S.C. 154(b) by 168 days.

(21) Appl. No.: 10/508,734

(22) PCT Filed: Feb. 18, 2003

(86) PCT No.: PCT/EP03/01597

§ 371 (c)(1),
(2), (4) Date: Sep. 21, 2004

(87) PCT Pub. No.: WO03/081048

PCT Pub. Date: Oct. 2, 2003

(65) Prior Publication Data

US 2005/0163632 A1 Jul. 28, 2005

(30) Foreign Application Priority Data

Mar. 22, 2002 (DE) ..... 102 12 940

(51) Int. Cl.
*F04C 18/107* (2006.01)
*F04C 18/344* (2006.01)

(52) U.S. Cl. ..... 418/55.1; 418/64; 418/220

(58) Field of Classification Search ..... 418/54, 418/55.1, 64, 220
See application file for complete search history.

(56) References Cited

U.S. PATENT DOCUMENTS 3,274,944 A * 9/1966 Parsons ..... 418/55.1
5,062,778 A 11/1991 Hattori et al. ..... 418/220
5,174,737 A 12/1992 Sakata et al. ..... 418/55.1
5,542,832 A 8/1996 Sone et al. ..... 418/152
6,186,759 B1 * 2/2001 Hayano et al. ..... 418/220
6,354,825 B1 3/2002 Fujiwara et al. ..... 418/220
6,425,744 B2 * 7/2002 Ozu et al. ..... 418/220
6,776,588 B1 8/2004 Meyer et al. ..... 417/250

FOREIGN PATENT DOCUMENTS

| | | |
|---|---|---|
| DE | 43 00 274 A1 | 7/1994 |
| DE | 43 37 064 A1 | 5/1995 |
| DE | 199 62 455 A1 | 6/2001 |
| EP | 0 464 683 A1 | 1/1992 |
| JP | 05-280479 | 10/1993 |
| JP | 10-061575 | 3/1998 |
| JP | 10-184561 | 7/1998 |
| JP | 11-351172 | 12/1999 |

* cited by examiner

*Primary Examiner*—Michael Koczo, Jr.
(74) *Attorney, Agent, or Firm*—Fay Sharpe LLP

(57) ABSTRACT

A pump (1) is provided with a housing (2), having an inlet (28) and an outlet (29), a drive (5), a fixed cylinder (2) centered on a mid-axis (9), a displacer (18), rotating eccentrically within the cylinder (2), a crank drive (13) for the displacer (18), a circumferential sickle-shaped pumping chamber (26) between the cylinder (2) and displacer (18) and a helical sealing element (27, 27', 27", 39) in the pumping chamber (26). The pump is a dry vacuum pump, whereby the displacer (18) circulates in the cylinder (2) without making contact.

40 Claims, 5 Drawing Sheets

Fig.3
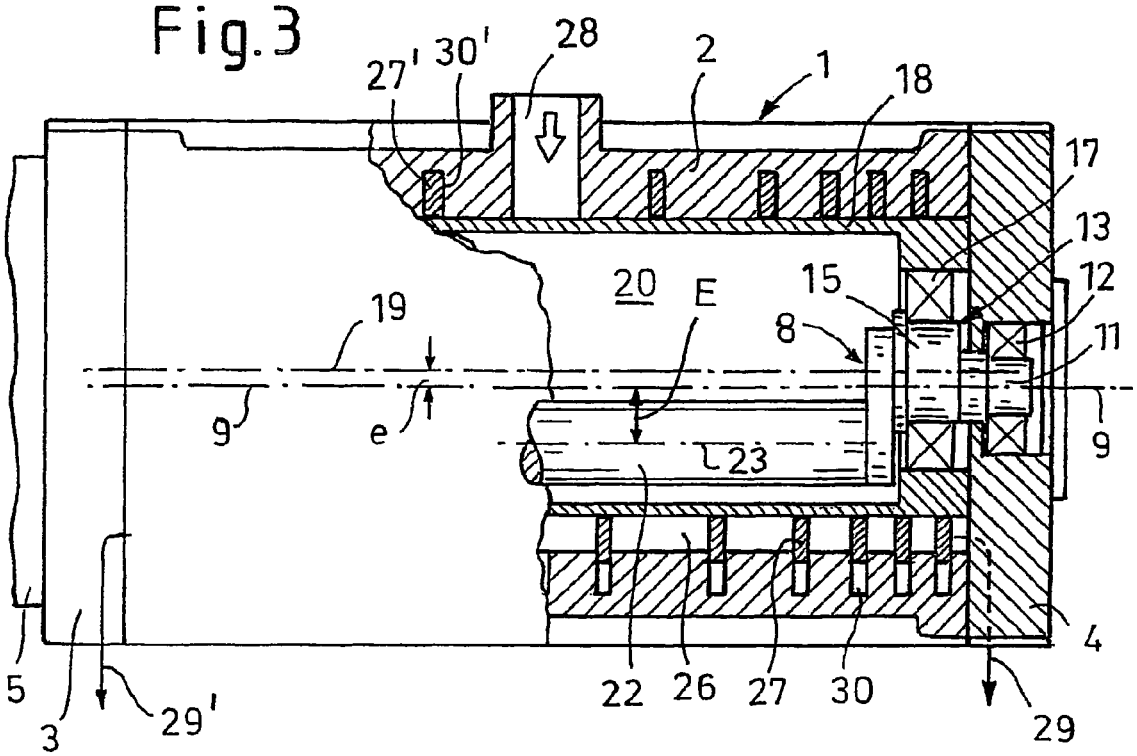
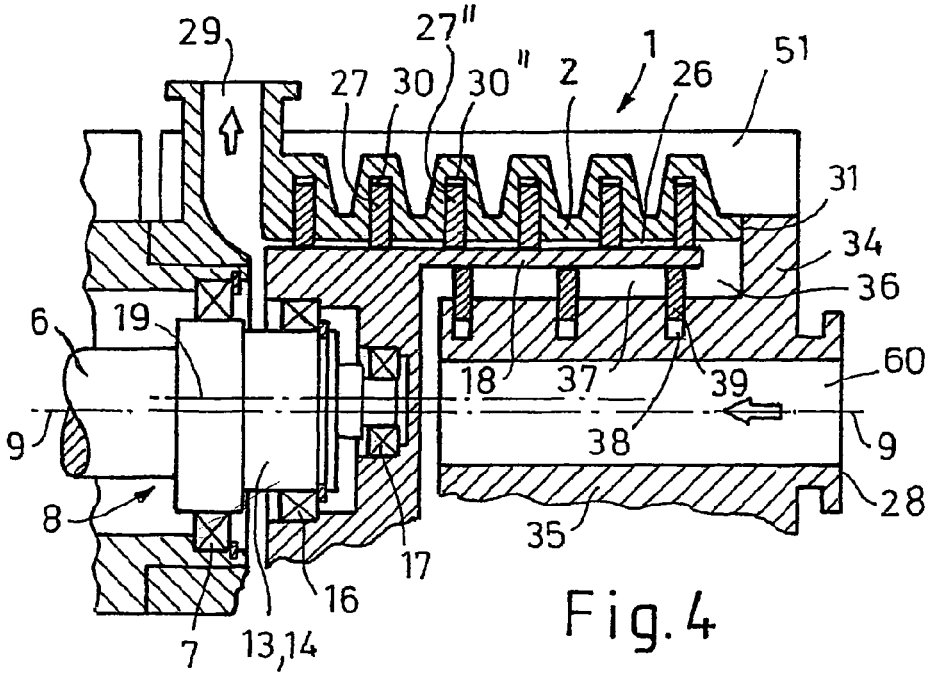
Fig.4

ECCENTRIC PUMP AND METHOD FOR OPERATION OF SAID PUMP

BACKGROUND

The invention relates to a pump with a housing, having an inlet and an outlet, a fixed cylinder central to a mid-axis of the pump, a displacer, planetating eccentrically within the cylinder, a crank drive for the displacer, a circumferential sickle-shaped pumping chamber between the cylinder and displacer and a helical sealing element in the pumping chamber. Moreover, the present invention relates to a method for operating such a pump.

A pump having the characteristics mentioned is known from U.S. Pat. No. 5,174,737. It has the function of a compressor and is preferably intended for compressing the gas of a refrigerant circuit.

It is the task of the present invention to design a pump of the aforementioned kind such that it may be employed as a dry running vacuum pump.

Over the past years, the customers have required from the manufacturers of vacuum pumps, dry running vacuum pumps at an increasing rate. These are to be understood as pumps, the pumping chambers of which are free of lubricant. In the instance of pumps of this kind there no longer exists the risk of hydrocarbons diffusing into the chambers to be evacuated by the pumps and thereby impairing the processes (semiconductor production, evaporation processes, chemical processes etc.) being performed within the chambers.

Dry running rotary vane pumps are known. The parts (vanes, inside wall of the pumping chamber) which slide under friction exhibit a comparatively high relative velocity. For this reason, the service life of the vanes and thus the pumps themselves is limited. Scroll vacuum pumps are better suited for dry operation. These comprise a fixed and a revolving component which support helical pumping elements engaging into each other. Their manufacturing costs are high. Moreover, they need to be subjected to maintenance frequently so as to ensure reliable continuous operation. Also dry piston vacuum pumps are offered on the market. Their manufacturing costs are also high, their construction volume is large. Other disadvantages are noise production and the unavoidable vibrations. Finally, dry two-shaft vacuum pumps (screw, Roots, claws vacuum pumps) are known. These offer pumping capacities commencing at approximately 20 $m^3/h$. Manufacture and deployment of vacuum pumps of this kind is usually, however, no longer economical at pumping capacities below 50 $m^3/h$.

SUMMARY

The eccentric vacuum pump in accordance with the present invention does no longer exhibit the disadvantages detailed. Friction is substantially limited only to the movement of the helical sealing element in its groove. Significantly less is the friction between the sealing element and the inside wall of the cylinder or the outside surface of the displacer, depending on the location of the groove guiding the pumping element. Since the displacer orbits, the relative velocities between the friction partners are, however, not high so that the wear is negligible, in particular when employing suitable materials.

Further advantages and details of the present invention shall be explained with reference to the schematically presented examples of embodiments in the drawing FIGS. 1 to 5.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

drawing FIG. 3 depicts a partial sectional view through a vacuum pump in accordance with the present invention of double flow design, drawing FIG. 4 depicts a partial sectional view through a vacuum pump in accordance with the present invention with two stages and cantilevered displacer drawing

DETAILED DESCRIPTION

Figure 1:
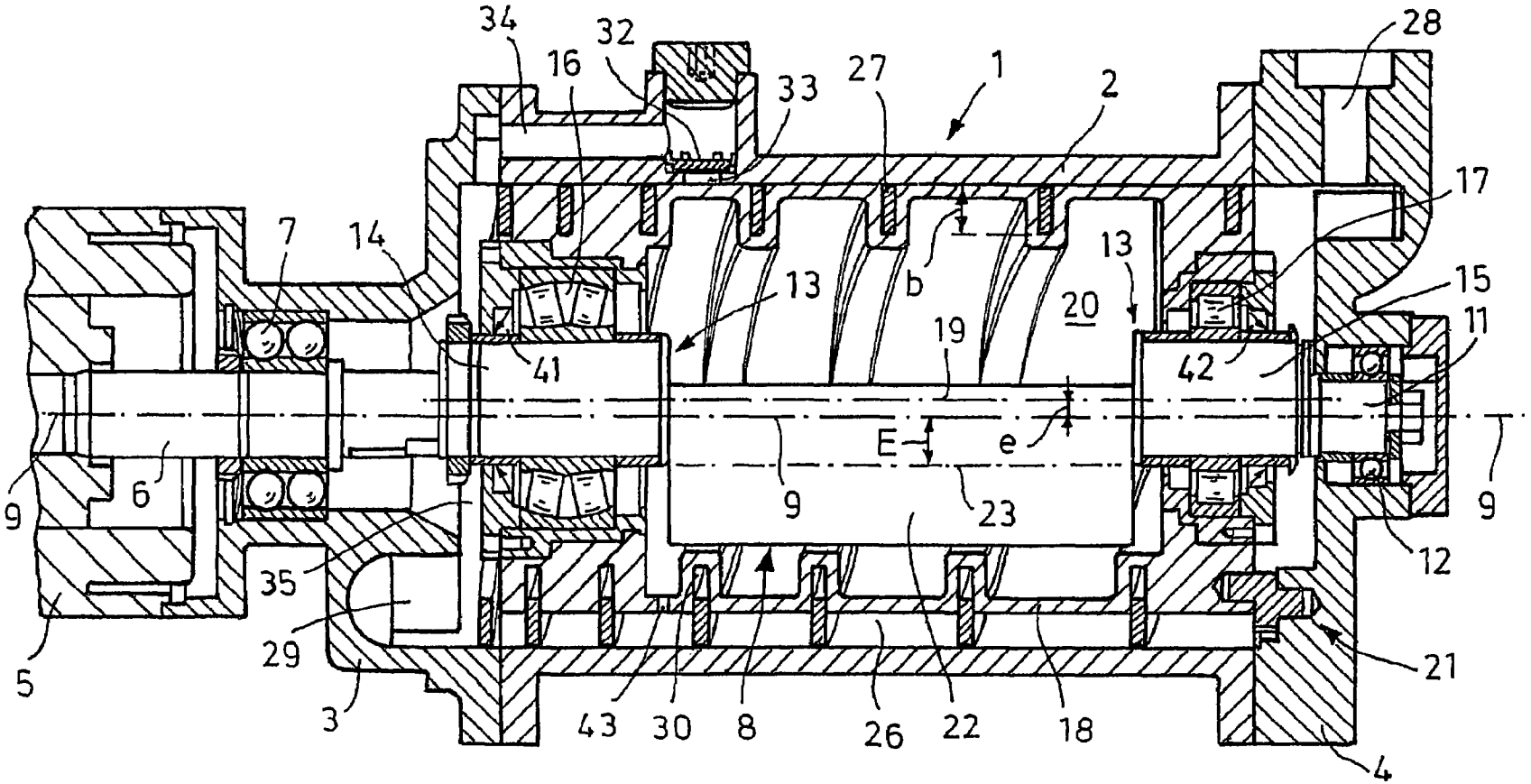
FIG. 1 depicts a sectional view through a vacuum pump in accordance with the present invention of single flow design with the displacer being supported by bearings at both sides, drawing

The vacuum pump 1 depicted in drawing FIG. 1 has a cylindrical housing 2 with cap or bearing pieces 3 and 4. Associated with the cap piece 3 is the drive motor 5. The motor shaft 6 penetrates the cap piece 3 and is supported in the bearing 7. The motor shaft 6 is a component of a planetary system 8, the mid-axis of rotation of which is designated as axis 9 and which is supported by means of a shaft connection piece 11 via the bearing 12 in the cap piece 4.

A further component of the planetating system 8 is a crank 13 which is located at the level of the cylindrical housing 2. e designates the eccentricity. The end sections 14 and 15 of the crank 13 are equipped with bearings 16 and 17 which support a hollow (hollow space 20) planetating displacer 18. The revolving movement of the substantially cylindrical displacer 18 is effected about the mid-axis 9. The crank axis is designated as 19. For the purpose of securing the axial position of the displacer 18, one of the two bearings 16, 17—in this instance bearing 16—is designed by way of a spherical roller bearing.

The cylindrical housing 2 which simultaneously has the function of a cylinder stator of pump 1 is arranged centrally with respect to the mid-axis 9. The diameter of the displacer 18 is selected such that it does not make contact with the inner wall of housing 2. The smallest distance between housing 2 and displacer 18 shall be as small as possible, expediently significantly less than 1 mm, 0.2 mm for example.

In order to prevent the turning motion of a planetating displacer it is known to employ torque supports (Oldham coupling, leaf springs, wire springs or alike). In the embodiment in accordance with drawing FIG. 1, an additional revolving eccentric is provided and designated as 21. It is supported by stubs in the displacer 18 and in the cap piece 4. For rotary bearing support of the eccentric within the displacer 18 and within the cap piece 4, dry plain bearings or grease lubricated rolling bearings (not depicted) may be employed, for example. For attaining an unambiguous kinematic condition for the displacer 18, at least two eccentrics 21 need to be employed which are, for example, arranged offset by 120°. The depicted kinematics result in a planetary motion of the displacer 18 relative to crank 13 with axis of rotation 19.

The middle, substantially cylindrical section 22 of the crank 13 with its axis 23 is also arranged eccentrically with respect to mid-axis 9, specifically exhibiting eccentricity E. The directions of the eccentricities e and E are opposed to each other. The eccentricity E and the mass of the middle section 22 are selected such that unbalance forces causing the masses of the rotating crank sections 14 and 15 with bearings 16 and 17 as well as the mass of the planetating displacer 18 during operation of the pump 1, are compensated.

Located between the housing 2 and the displacer 18 is the sickle-shaped pumping chamber 26. A helical sealing element or band 27 forms the pumping chambers which move from the inlet 28 of the pump 1 to the outlet 29. On the inlet side, pumping chambers are created continuously which close during the rotary movement of the displacer 18 and which only open again on the outlet side. In the embodiment depicted in drawing FIG. 1 the inlet 28 is located at cap piece 4. An outlet chamber 29 is located in cap piece 3. An adjacent outlet port is not depicted.

The sealing element 27 is a helical, flexible rectangular band, the cross-section of which is long stretched out. It is guided in a groove 30 in the displacer 18. In the relaxed state the sealing element 27 exhibits an outside diameter which is slightly larger than the inside diameter of the bore in cylinder 2. Thus, in the fitted state it is subjected to an initial tension acting radially towards the outside, so that leak tight resting of the sealing element 27 against the inside wall of the housing 2 is ensured. The radial width b of the sealing element 27 is greater than twice the magnitude of the eccentricity e. Thus the closed state of the pumping chambers during their motion from inlet 28 to outlet 29 as well as reliable guidance of the sealing element 27 within the groove 30 is ensured, and reverse flows are prevented. Play of the sealing element 27 within the groove 30 should be as small as possible, for example 0.2 mm.

Although there exists between housing 2 and the sealing element 27 no significant friction, torque caused by friction between sealing element 27 and groove 30 is exerted on the sealing element 27 during operation of the pump 1. A therefrom resulting axial shift of the sealing element 27 is expediently prevented by barriers. Such a barrier may, for example, be designed by way of a stop within the groove 30 of the displacer 18. Another possibility exists in that an end section of the sealing element 27 is affixed at the housing 2 or at one cap piece 3, 4 in such a manner that the end section cannot turn about the axis 9, but nonetheless exhibits in the axial direction a slight amount of play (see drawing FIG. 2).

In the embodiments depicted in drawing FIG. 1 the pitch of the groove 30 in displacer 18 decreases steadily and thereby also the pitch of the sealing element 27 decreases steadily from the inlet 28 to the outlet 29. The same applies also to the volumes of the pumping chambers moving from the inlet 28 to the outlet 29 so that a compression of the sucked in gases is effected. In order to avoid, at the beginning of an evacuation phase, inadmissibly high overpressures within the pump, a relief valve 32 is provided. It is located between inlet 28 and outlet 29 and opens a bore 33 within housing 2, should inadmissibly high pressures occur. The relief is effected through channels 34, 35 which run directly to the outlet 29.

In the example of the embodiment according to drawing FIG. 1 the chance that the hollow space 20 of the displacer 18 creates a short-circuit between inlet 28 and outlet 29 and that hydrocarbons from this hollow space 20 enter into the area of the inlet is to be prevented. These tasks are fulfilled firstly by the seals 41, 42 which seal off the passages of the end sections 14, 15 of the crank 13 through the face side openings within displacer 18. Moreover, it is expedient to employ for lubricating the bearings 16, 17 a grease which is free of hydrocarbons. Finally it is expedient to maintain within the inner chamber 20 of the displacer a low pressure, 80 mbar for example. This may be effected by means of a bore 43 within the displacer wall. The bore opens out into the pumping chamber 26 specifically within the area in which the desired internal pressure within the hollow space of the displacer prevails. Through this provision the pressure difference present at the seal 42 is considerably reduced.

Figure 2:
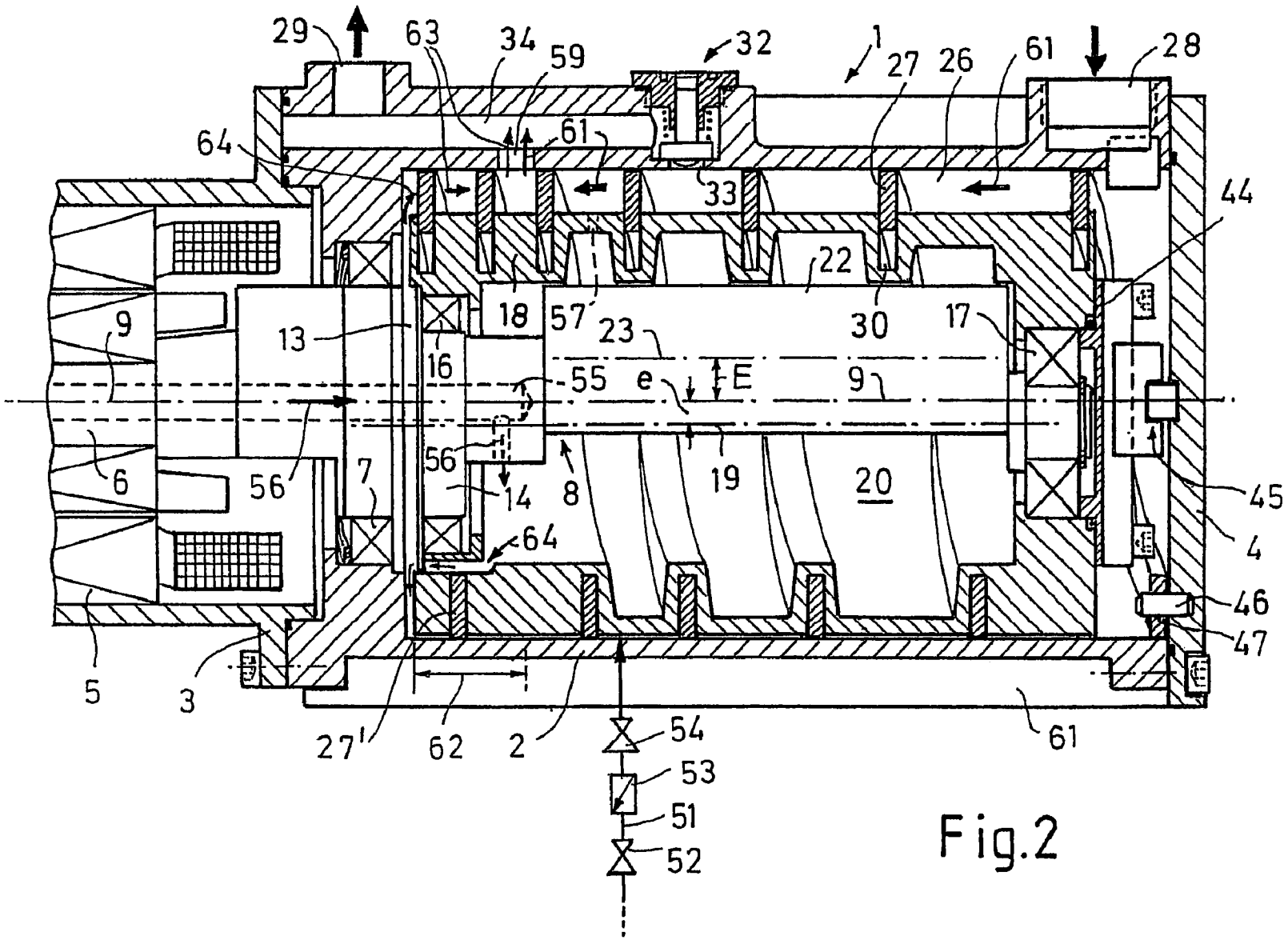
FIG. 2 depicts a sectional view through a vacuum pump in accordance with the present invention of single flow design with a cantilevered displacer, drawing

The embodiment depicted in drawing FIG. 2 differs from the embodiment in accordance with drawing FIG. 1 in that the planetating system 8, as well as the thereby supported displacer 18, are supported in a cantilevered manner on the shaft 6. The shaft 6 in turn is supported by the bearing 7 in the pump housing 2 and a further, not depicted, bearing in the motor housing. This provision offers the advantage that the hollow inside space 20 of the displacer 18 can be sealed off tightly (cover 44) on the intake side. For the purpose of preventing the turning movement of the displacer 18, an Oldham coupling 45 is provided. The sealing element 27 is affixed by means of an axial pin 46 at cap piece 4. The pin 46 penetrates a bore 47 in the sealing element 27 which prevents the sealing element from rotating about the axis 9, permitting, however, play in the axial direction.

Two variants for a gas ballast supply are depicted. In the first variant, the ballast gas enters through a line 51 from outside through a bore, not specifically depicted, in housing 2 into the pumping chamber 26. In the line 51 there are present a blocking valve 52, a non-return valve 53 and a differential pressure valve 54. A gas ballast facility of this kind is known from U.S. Pat. No. 6,776,588.

Figure 6:
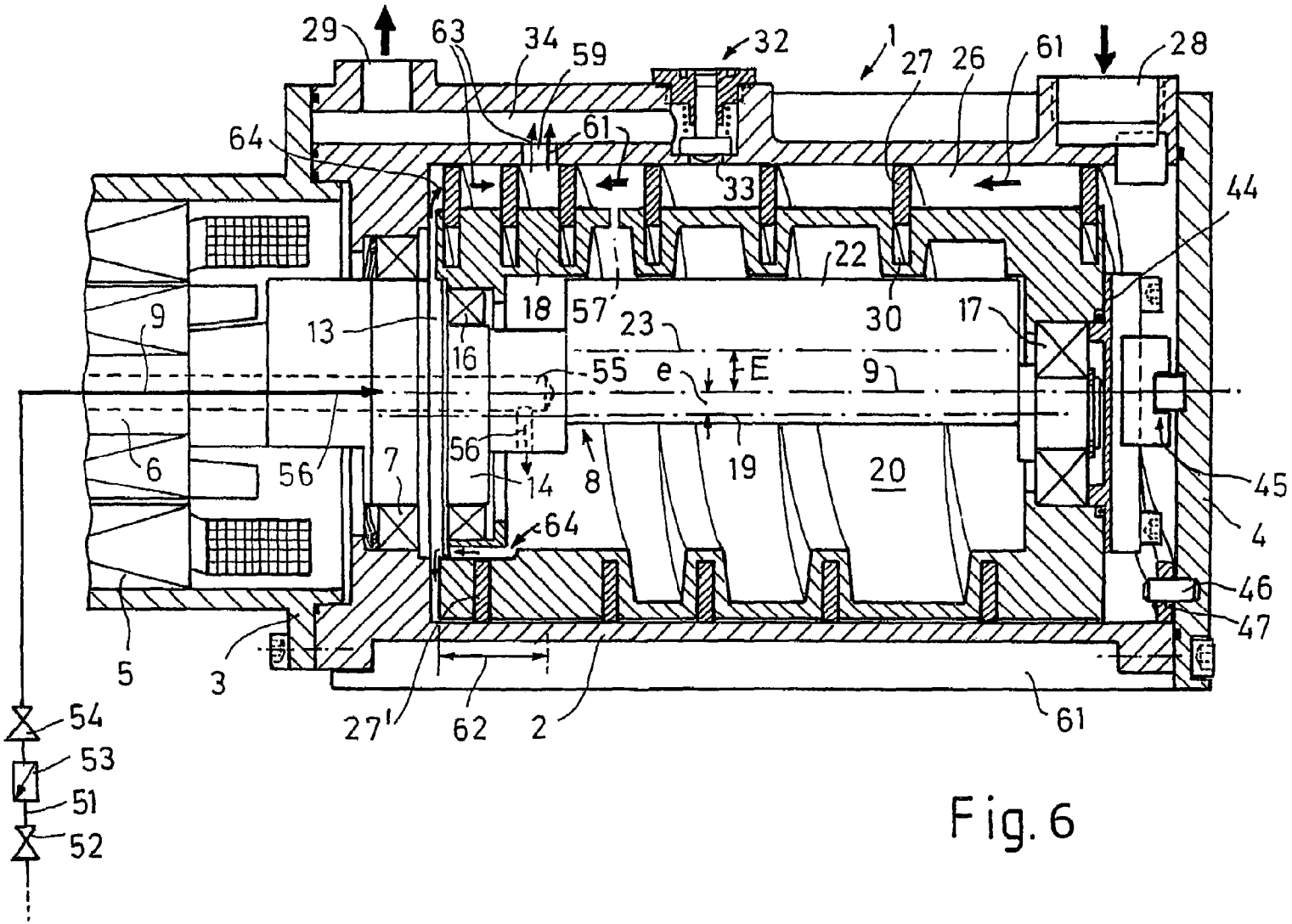
FIG. 6 depicts a variant ballast gas supply.

In the second variant, the ballast gas is additionally (drawing FIG. 2) or alternately (drawing FIG. 6) supplied through the hollow space 20 of the displacer 18. A system of channels 55 in the planetating system 8 forms the link to the outside.

Ballast gas (arrows 56) supplied through the system of channels passes through a bore 57 (depicted by dashed lines) in the displacer wall into the pumping chamber 26. The advantage of this embodiment is such that the displacer is cooled from the inside by the ballast gas.

In the embodiment in accordance with drawing FIG. 2 the gases pumped by the pump exit the pumping chamber 26 through a bore 59 in housing 2. The bore opens out into the channel 34 which is linked to the outlet 29 of the pump. The planetary movement of the displacer 18 and the pitch of the helical groove 30 are so selected that during operation of the pump 1, the individual pumping chambers in the pumping chamber 26 move from the inlet 28 to the bore 59 (arrow 61). In the instance of the embodiments depicted, the displacer 18 with its section 62 extends over the bore 59. The same also applies to the groove 30. However, the pitch of the groove 30 is so selected that a further, independent sealing element 27' forms pumping chambers which oppose (arrow 63) the direction of the pumping action between inlet 28 and bore 59. Ultimately the pump is of a double flow design. It exhibits two pumping stages which provide a pumping action from the respective face sides in the direction of bore 61. If a link is provided between the hollow space 20 of the displacer and the suction side of the section 62 (arrows 64), then there exists the possibility of maintaining a low pressure within the hollow space 20. Moreover, effective cooling of the pump can be implemented. Cooling gas flowing through the system of channels 55 in the planetating system 8 into the hollow space 20 passes on to the suction side of the section 62 and is removed from the pumping chamber 26 jointly with the pumped gas through the bore 59 and the outlet 29. In this manner it is also prevented that gas can pass from the inlet 28 of the pump into the hollow space 20 and the therein located bearings 7, 16 and 17. This is, for example, desirable when corrosive or caustic gases shall be pumped.

Drawing FIG. 3 depicts a double flow design with a center inlet 28 and two face side outlets 29 and 29' indicated only by arrows. Located to the side of inlet 28 are two pump sections of which only one is depicted. The section not visible is designed as a reversed image with respect to the visible section. The two pumping sections provide a pumping action each from the inlet 28 to the outlets 29, 29' respectively. The rotating system 8 (axis 9) as well as the rotating displacer 18 extend over the entire length of the pump 1. Driving is effected through the motor 5 and a vacuum coupling not depicted in detail. Two sealing elements 27, 27' form the pumping chambers which move from inside to outside. In contrast to the embodiment in accordance with drawing FIG. 1, the grooves 30, 30' guiding the sealing elements 27, 27' are located in housing 2. The respective inner narrow side of the sealing element 27, 27' rests against the cylindrical outer wall of the displacer 18. This is attained in that the helical sealing elements 27, 27' have, in the relaxed state, a diameter which is smaller than the outside diameter of the displacer 18.

The special advantage of the embodiment in accordance with drawing FIG. 3 is that the two outlets 29, 29' are arranged on the face sides. The two face sides of the displacer need no longer to be sealed off in a vacuum-tight manner. There even exists the possibility of modifying the pump such that a cooling agent—for example, cooling air supplied by a fan—flows through the hollow space 20. A further advantage is that no significant axial forces are exerted on the bearings because axial gas forces and friction forces cancel each other.

In the embodiment in accordance with drawing FIG. 4, a two-stage pump 1 according to the present invention is presented. It has an outer housing 2 with two helical grooves 30 and 30", in which a sealing element 27, 27" is guided in each one. The arrangement corresponds to that of a double thread. The sealing elements 27, 27" rest against the cylindrical outer surfaces of the rotating displacer 18. These form pumping chambers which in the sickle-shaped pumping chamber 26 move from the free side face 31 of the housing 2 to the outlet 29 of the pump 1.

Both the crank 13 (crank section 14) and also the rotating displacer 18 are cantilevered such that in the area of the side face 31 bearings are no longer required. The crank section 14 exhibits a step. The displacer 18 is supported in a cantilevered manner by the two bearings 16, 17 having different diameters.

In the example of the depicted two-stage version, a further pump stage is located upstream of the pump stage formed by the sealing elements 27, 27" and the outside wall of the displacer 18. To this end, the displacer 18 is designed according to the type of a double pot.

Located in one of the hollow spaces on the face side are the crank 13 as well as the bearings 16, 17. Located in the second—opposite—hollow space 36 with the side face 31, is a further pumping stage. In the housing 2, a cylindrical component 35 is affixed centrally with respect to axis 9 by means of a flange 34, the cylindrical component extending into the inner space 36 of the displacer 18. The diameter of the cylindrical component is so selected that its outside wall and the inside wall of the displacer 18 form a further sickle-shaped pumping chamber 37. The outside wall of the cylindrical component 35 (or the inside wall of the displacer 18) is equipped with a helical groove 38 in which a further sealing element 39 is guided.

The pump stage formed by component 35, displacer 18 and the sealing element 39 serves as the first stage of a two-stage pump 1 in accordance with the present invention. It pumps from the bearing side in the direction of the side face 31. In this area, the pumping chambers 37 and 26 are linked to each other. The inlet 28 is formed by a central bore 60 in component 35. The pitches of the groove 38 in the component 35 and the grooves 30, 30' in housing 2 are constant (easy to manufacture) but selected to differ in size. The pitch of the groove 38 is greater than the pitch of the grooves 30, 30'. During the passage through the two-stage pump 1 a compression of the pumped gases is effected. A special advantage of the embodiment detailed is that the high-pressure stage is located outside. The heat mostly generated in the high-pressure stage can be simply dissipated, be it through cooling channels in housing 2 or—as shown—through heat sinks 51 having a relatively large surface area.

Figure 5A:
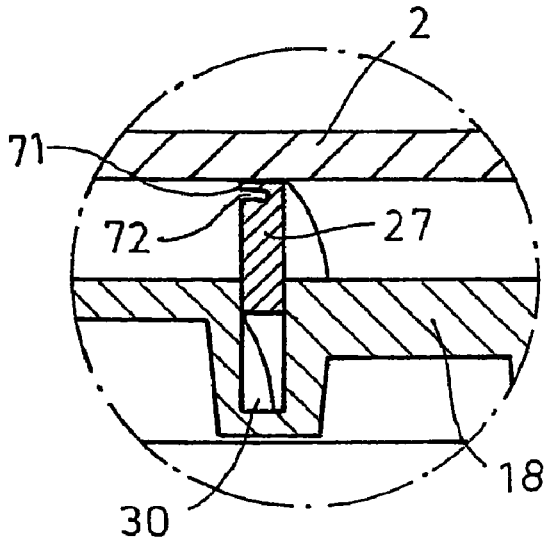
FIGS. 5*a*, 5*b*, and 5*c* depict sectional views through the helical sealing element, and, drawing
Figure 5B:
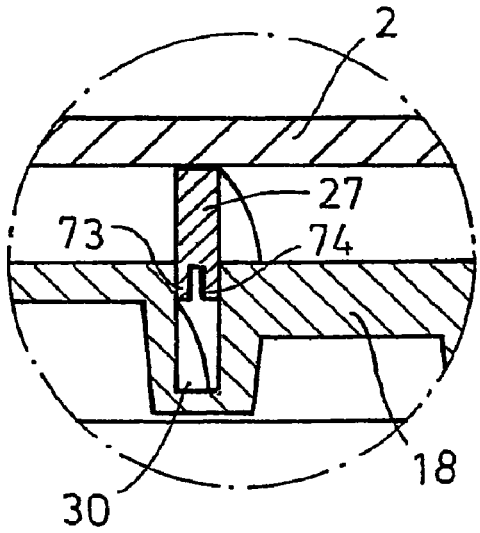
Figure 5C:
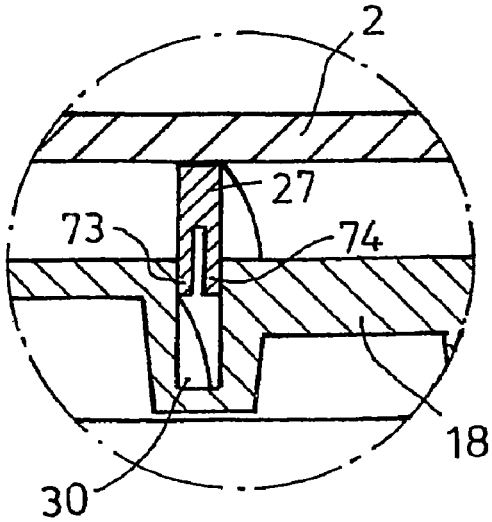

The helical sealing element 27, 27', 27", 39 has the task of mutually sealing the pumping chambers moving from the intake side to the delivery side. Moreover, the frictional resistance between the sealing element and the involved components 2, 18, 35 is minimal. In the drawing FIGS. 5*a* to 5*c* embodiments of the sealing elements 27 are depicted. In the embodiment in accordance with drawing FIG. 5*a* the sealing element 27 rests flush against the inner side of the stator housing 2 with a substantially axially oriented sealing lip 71. The recess 72 located under the sealing lip 71 is open towards the side at the higher pressure so that a flexible and reliable contact of the sealing lip 71 is ensured. The embodiments of the sealing element 27 in accordance with drawing FIGS. 5*b* and 5*c* exhibit in the area of the groove 30 radially oriented sealing lips 73, 74 differing in length. These have the effect of a reduced friction resistance between the sealing element and the side walls of the groove.

The examples of embodiments detailed differ chiefly with respect to their bearings as well as with respect to the number, pitch and selection of the location of the guide grooves for the sealing element(s). As a precaution it is pointed out that the variants detailed here can be implemented in any of the examples of embodiments detailed. The present invention permits, at low manufacturing cost, the production of a compact, dry running, low noise and low vibration vacuum pump which is also economical at low pumping capacities (under 50 $m^3/h$). It suffices when the rotational speed of the planetating components is between 1500 and 3600 rpm. Cooling of the pump is simple since all important components are in contact with the atmosphere.

Of importance to the service life of the pump is the selection of the materials for the components between which there is friction. For the helical sealing element 27, 27', 39, PTFE or a PTFE compound is well proven, as employed also in piston or scroll vacuum pumps. The displacer 18 and/or the housing 2 as well as the component 35 consist expediently of an aluminium material, preferably of a hard anodized aluminum alloy, AlMgSi1, for example. When employing these or similar materials it is possible, in spite of the absence of lubricants in the pumping chamber, to permit high sliding velocities between the sealing element(s) and the related grooves. The sliding velocity depends on the rotational speed of the crank and on the degree of eccentricity e. The higher these values are, the more compact a pump offering a certain pumping performance can be manufactured. Expediently, planetating speed and eccentricity are so selected that the sliding velocity ranges between 1 and 5 m/s, preferably 4 and 5 m/s.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

The invention claimed is:

1. A pump comprising:

a drive, a fixed cylinder with a mid-axis, the fixed cylinder being connected with an inlet and an outlet;

a displacer planetating eccentrically within the fixed cylinder, a crank drive connected with the drive and the displacer, a circumferential sickle-shaped pumping chamber defined between the cylinder and displacer, and a helical sealing element supported on the displacer in the pumping chamber, the pump being a dry vacuum pump, whereby the displacer planetates in the cylinder without making contact with the cylinder.

2. The pump according to claim 1, wherein the smallest distance between the displacer and an inside wall of the cylinder does not exceed 1 mm.

3. The pump according to claim 1, wherein the cylinder is a component of a pump housing.

4. The pump according to claim 1, wherein the displacer defines a hollow space.

5. The pump according to claim 4, wherein a cooling gas flows through the hollow space.

6. The pump according to claim 1, wherein means are provided which prevent turning of the displacer about the mid-axis of the cylinder.

7. The pump according to claim 1, wherein means are provided which prevent turning of the sealing element about the mid-axis of the cylinder.

8. The pump according to claim 1, wherein an outside wall of the displacer is equipped with a helical groove for the sealing element.

9. The pump according to claim 8, wherein the helical sealing element has, in the relaxed state, an outside diameter which is greater than an inside diameter of the cylinder.

10. The pump according to claim 1, wherein the inside wall of the cylinder is equipped with a helical groove for the sealing element.

11. The pump according to claim 10, wherein the helical sealing element, in a relaxed state, has an inside diameter which is smaller than an outside diameter of the displacer.

12. The pump according to claim 8, wherein the sealing element exhibits, in the area of the groove, approximately radially oriented sealing lips.

13. The pump according to claim 8, wherein the sealing element includes a substantially axially orientated sealing lip in a side face thereof.

14. The pump according to claim 8, wherein two or more grooves are provided as a double or multiple thread as well as a corresponding number of sealing elements.

15. The pump according to claim 8 wherein a pitch of the groove from the inlet to the outlet decreases.

16. The pump according to claim 15, further comprising a relief valve which is located between the inlet and the outlet.

17. The pump according to claim 1, further comprising a rotary system with a crank, the crank being driven by the drive via a shaft, said rotary system with the crank supporting the displacer via bearings.

18. The pump according to claim 17, wherein the crank includes two crank sections in bearing pieces, one section on each side of the pump housing, and the rotary system is supported, via bearings, through the two crank sections.

19. The pump according to claim 17, wherein one crank section is cantilevered and where the displacer is supported in a cantilevered manner by the crank section.

20. The pump according to claim 17, wherein at least one mass balancing weight is part of the rotary system.

21. The pump according to claim 20, wherein the displacer includes a hollow space, the mass balancing weight being located in a hollow space.

22. The pump according to claim 1, wherein the pump is of a double flow design.

23. The pump according to claim 22, wherein the inlet is a central inlet and the outlet includes outlets located on side faces of the housing.

24. The pump according to claim 1, wherein the pump is of a two-stage or multi-stage design.

25. The pump according to claim 24, wherein the displacer substantially has the shape of a double pot which includes first and second hollow spaces, and wherein bearings of the displacer are located in one of the hollow spaces and a pumping stage is located in the other hollow space.

26. The pump according to claim 25, wherein a component is fixed to the housing and projects into the hollow space with a cylindrical outer surface that forms, jointly with an inside wall of the displacer, a further pumping stage.

27. The pump according to claim 26, wherein a bore penetrating the component forms the inlet.

28. The pump according to claim 24, wherein volumes of pumping chambers in a stage on an intake side are greater than volumes of the pumping chambers of a pump stage on a delivery side.

29. The pump according to claim 1, further comprising a gas ballast facility connected with the pumping chamber.

30. The pump according to claim 29, wherein the housing is equipped with a bore through which ballast gas is supplied via a line equipped with a valve.

31. The pump according to claim 4, further comprising a rotary system, wherein the rotary system is equipped with a system of channels through which the hollow space in the displacer is connected to the surroundings.

32. The pump according to claim 31, wherein the displacer is equipped with a bore and wherein the system of channels serves the purpose of supplying ballast gas.

33. The pump according to claim 31, wherein the system of channels serves the purpose of supplying cooling air.

34. The pump according to claim 22, wherein the displacer includes a hollow space and is equipped with a bore, the system of channels serves the purpose of supplying cooling air, and the outlet is served by a joint discharge bore, a direction of the pumping action of two pump stages being from respective side faces of the housing to the joint discharge bore whereby one of the pump stages serves the purpose of removing the cooling air from the hollow space of the displacer.

35. The pump according to claim 1 wherein the helical sealing element consists of a PTFE containing material and the displacer and the housing consist of an aluminium material.

36. The pump according to claim 1, wherein one of an outside wall of the displacer and an inside wall of the cylinder is equipped with a helical groove for the sealing element and the rotational speed and eccentricity are so selected that a sliding velocity between the helical sealing element and a side wall of the related groove is between 1 and 5 m/s.

37. A method for operating a pump with a housing, having an inlet and an outlet, a drive, a fixed cylinder centered on a mid-axis, a displacer disposed to planetate eccentrically within the cylinder, a crank drive for the displacer, a circumferential sickle-shaped pumping chamber between the cylinder and displacer, and a helical sealing element supported by the displacer in the pumping chamber, the method comprising:

operating the pump as a vacuum pump, the pumping chamber being operated free of lubricants and the crank drive guiding the displacer such that it planetates in a non-contact manner within the cylinder.

38. The method according to claim 37 wherein the pump is operated with inner compression.

39. The method according to claim 37, wherein the displacer includes a hollow space, the method further comprising: maintaining a vacuum pressure in the displacer.

40. The method according to claim 37, wherein the displacer includes a hollow space, the method further comprising: flowing cooling air or ballast gas through the hollow space of the displacer.

* * * * *